US009450315B2

(12) United States Patent
Royer

(10) Patent No.: US 9,450,315 B2
(45) Date of Patent: Sep. 20, 2016

(54) HIGH VOLTAGE ELECTRICAL CONNECTOR

(71) Applicant: Tyco Electronics Simel SAS, Gevrey-Chambertin (FR)

(72) Inventor: Laurent Royer, Courlon (FR)

(73) Assignee: Tyco Electronics Simel SAS, Gevrey-Chambertin (FR)

( * ) Notice: Subject to any disclaimer, the term of this patent is extended or adjusted under 35 U.S.C. 154(b) by 57 days.

(21) Appl. No.: 14/355,188

(22) PCT Filed: Oct. 30, 2012

(86) PCT No.: PCT/EP2012/071514

§ 371 (c)(1),
(2) Date: Apr. 29, 2014

(87) PCT Pub. No.: WO2013/064515

PCT Pub. Date: May 10, 2013

(65) Prior Publication Data

US 2014/0345938 A1 Nov. 27, 2014

(30) Foreign Application Priority Data

Nov. 2, 2011 (EP) ..... 11290507

(51) Int. Cl.
*H01R 4/46* (2006.01)
*H01R 43/027* (2006.01)
*H01R 4/60* (2006.01)

(52) U.S. Cl.
CPC ..... *H01R 4/46* (2013.01); *H01R 43/027* (2013.01); *H01R 4/60* (2013.01); *Y10T 29/49208* (2015.01)

(58) Field of Classification Search
CPC ..... H01R 4/46; H01R 4/363; H01R 4/36; F16L 3/26; F16L 3/18; F16L 3/14; F16L 3/2235; F16L 3/12; F16L 3/13; F16L 3/10; F01N 13/1822; H02G 7/053
USPC ..... 439/785, 797, 798, 811; 248/49, 55, 60, 248/62, 63, 68.1, 74.1–74.4
See application file for complete search history.

(56) References Cited

U.S. PATENT DOCUMENTS 1,905,967 A * 4/1933 Milne ..... H02G 7/053 24/135 L
3,100,672 A * 8/1963 Myers ..... H01R 4/44 24/135 L (Continued)

FOREIGN PATENT DOCUMENTS

CH 328224 A 2/1958
DE 1020703 B 12/1957

(Continued)

OTHER PUBLICATIONS

International Preliminary Report on Patentability issued by the International Bureau of WIPO, Geneva, Switzerland, dated May 6, 2014, for International Application No. PCT/EP2012/071514; 7 pages.

(Continued)

*Primary Examiner* — Thanh Tam Le
(74) *Attorney, Agent, or Firm* — Faegre Baker Daniels LLP

(57) ABSTRACT

An electrical connector for connecting a conductor with three fixations and particularly suitable for medium and high voltage applications. The connector body includes a body part with an inner profile adapted to receive the conductor and a cover part provided with two keepers that are fastened to the body part for providing the first and the second fixation of the conductor to the body part, respectively. The third fixation of the conductor is provided by an inner keeper that is partially covered by the two outer keepers. The inner keeper includes a contact element that is disposed transversally over the conductor and attached to the body part by a U-bolt. The outer keepers and the inner keeper are shaped so that at least one of the outer keepers covers, at least partially, the inner keeper.

27 Claims, 8 Drawing Sheets

(56) References Cited

U.S. PATENT DOCUMENTS

| | | | | |
|---|---|---|---|---|
| 4,458,976 | A | 7/1984 | Hudson et al. | |
| 5,768,882 | A * | 6/1998 | Weber | F16G 13/16 248/49 |
| 5,941,483 | A * | 8/1999 | Baginski | F16L 3/22 248/68.1 |
| 6,135,398 | A * | 10/2000 | Quesnel | H02G 7/053 248/74.1 |
| 6,595,472 | B1 * | 7/2003 | Pisczak | H02G 7/053 248/74.1 |
| 6,595,473 | B2 * | 7/2003 | Aoki | B60R 16/0215 138/108 |
| 6,892,990 | B2 * | 5/2005 | Pisczak | H02G 7/053 248/62 |
| 7,182,301 | B1 * | 2/2007 | Oddsen, Jr. | F16M 13/02 248/122.1 |
| 7,770,848 | B2 * | 8/2010 | Johnson | F16L 3/1207 248/65 |

FOREIGN PATENT DOCUMENTS

| | | | |
|---|---|---|---|
| DE | 973551 | C | 3/1960 |
| FR | 1537984 | A | 8/1968 |

OTHER PUBLICATIONS

International Search Report and Written Opinion issued by the European Patent Office, dated Jan. 14, 2013, for related International Application No. PCT/EP2012/071514; 11 pages.

* cited by examiner

HIGH VOLTAGE ELECTRICAL CONNECTOR

TECHNICAL FIELD OF THE INVENTION

The present invention relates generally to electrical connectors used in medium and high voltage applications for the connection of electrical conductors, and more specifically, to bolted connectors provided with connector parts for fixing the conductor at three contact regions along the conductor by means of contact pressure.

BACKGROUND OF THE INVENTION

Bolted connectors have been widely used in high voltage applications, such as power stations and underground power distribution networks, for connecting electrical cables to other equipments such as main power supply cables or other electrical cables for forming cable networks.

Conventional bolted connectors are formed by several connector parts, which generally include a body part for receiving the part of the connector to be connected and one or more mechanical tightening parts, also-called keepers. The connector parts are assembled together around the conductor and brought into contact with the conductor by a number of bolts and nuts, thereby, establishing both electrical contact and contact pressure on the conductor.

An advantage of bolted-type connectors in comparison with other known types of connectors lies in their robustness, namely, against environmental conditions. However, since the quality of the electrical contact and the mechanical tightening strength of bolted connectors is directly dependent on the length of the connector and the number of mechanical tightening parts, several countries impose restrictions in terms of connector size and/or number of tightening parts in order to meet safety and performance requirements. For instance, several national specifications impose a connector design based on six tightening bolts.

Further, in order to establish a good electrical contact with the conductor, the connector parts are generally made of electrical conductive materials such as aluminium or copper alloys which render the connector relatively expensive. For these reasons, existing bolted connectors complying with current standards are generally bulky and uncompetitive in terms of cost.

An example of a conventional connector 100 compliant with the 6 bolt requirement and already installed in the market over the past 30 years is shown in FIG. 1.

The connector body includes three keepers 110, 120, and 130 that are longitudinally disposed, side by side, along a conductor 140 and separately fastened to the body member 150 by three pairs of fasteners 160, 170, 180 for mechanically tightening the conductor at three different regions. The fasteners generally consist on three pair of bolts, for instance M16 bolts made of aluminium alloy, and respective tightening nuts (not shown).

This design has the disadvantage that the connector is relatively long and requires the use of a substantial quantity of raw material in its manufacture, which makes the connector heavy and very expensive. For instance, commercially available connectors of three-keeper design have a longitudinal length of about 224 mm and weight 6300 g.

FIG. 2 shows another example of a connector 200 that has been available on the market since recent years and also compliant with the 6-bolts requirement. As shown in FIG. 2, the connector 200 includes a single keeper 210 that is fastened by three pairs of bolts 220, 230, 240 to the body part

250 for clamping a longitudinal conductor 260. In this configuration, the single keeper 210 essentially replaces the three separate keepers of the previous design which allows obtaining some reduction of the connector longitudinal length. Typical parameters of single-keeper connectors currently available on the market are 200 mm of longitudinal length of 5600 g of weight, which represents savings in raw material of about 11% with respect to the three-keeper connector. This is however not sufficient for rendering the connector cost competitive.

Further, the considerable weight of these types of connectors renders them difficult to handle and to install, for instance, in electrical cables at a certain altitude from the ground.

Thus, there is a need for electrical connectors compliant with customer requirements and which are less expensive and easy to install.

SUMMARY OF THE INVENTION

The present invention aims at overcoming the disadvantages and shortcomings of the prior art techniques and an object thereof is to provide an electrical connector for medium and high voltage applications that is cost-effective and which facilitates the installation of the respective conductors or electrical cables on the connector itself.

This object is solved by the subject matter of the independent claims. Advantageous embodiments of the present invention are defined by the dependent claims.

According to the invention it is provided an electrical connector for medium and high voltage applications, comprising: a connector body comprising a body part having an inner profile adapted to receive a conductor therein, and a cover part having at least one outer keeper adapted to be fastened to the body part and to provide a fixation of the conductor; and an inner keeper adapted to be fastened to the body part and to provide a another fixation of the conductor. The inner keeper and the cover part are shaped so that the at least outer keeper covers, at least partially, the inner keeper.

According to a further development of the invention, the cover part has a first outer keeper and a second outer keeper, each outer keeper being adapted to provide a fixation of the conductor.

In this way, the first and second outer keepers provide a first and second fixation of the conductor to the connector, while the inner keeper provides a third fixation of the connector.

According to a further development of the invention, the first and second outer keepers are separate elements adapted to be symmetrically disposed on the body part with respect to the inner keeper and to substantially cover the inner keeper.

In a further development of the invention, the first and second outer keepers form a single covering element adapted to completely cover the inner keeper.

According to a further development, the inner keeper has an inner curved surface adapted to be disposed transversally over the conductor and to exert contact pressure on the conductor when fastened to the body part.

In a further development, the inner keeper comprises a strap adapted be disposed transversally over the conductor and to extend along a part of the conductor surface and is provided with inner keeper fastening means adapted to fasten the strap to the body part.

According to a further development, the inner keeper fastening means comprises a curved bolt having a curved profile to be arranged along an outer surface of the strap and terminated by straight ends adapted to pass through respective openings provided on the body part.

According to a further development the strap has a substantially C-shaped profile and the curved bolt is a U-bolt.

According to a further development, the outer surface of the strap has a flange adapted to accommodate the curved bolt.

According to a further development, the first outer keeper and the second outer keeper are each provided with a pair of through-holes and a pair of straight bolts for fastening to the body part, each through-hole of the pair being disposed transversally to the conductor and on each side of the conductor in such a manner that the through-holes on a same side are aligned in parallel to the conductor.

In a further development, the first and the second outer keepers have a profile on a side facing the body part that is adapted to exert contact pressure on the conductor when the first and the second outer keepers are fastened to the body part for providing the respective fixations. The at least one of the first and second outer keepers has a recess adapted to fit the inner keeper. The body part and the cover part are shaped so as to provide a smooth external shape of the connector body when assembled together.

According to a further development of the present invention, it is provided an electrical connector in which the inner profile of the body part defines a plurality of channels, each channel being adapted to accommodate a conductor therein, the connector comprising a cover part and an inner keeper as defined in any one of the preceding claims for fixing each conductor on the respective channel.

According to a further development, the body part has an extended form adapted to receive at least two conductors that are substantially perpendicular or parallel to each other therein, and to arrange the cover part and the inner keeper for fixing each conductor.

According to a further development, the first and the second keepers are adapted to sufficiently hold the conductor on the conductor body when the inner keeper is not in place.

This allows to use the electrical connector in applications where there is no need to comply with the requirement of three fixations per conductor.

The present invention also provides a method of connecting at least one conductor to an electrical connector according to the invention. The method comprises steps of: placing at least one conductor on the body part; disposing an inner keeper on the at least one conductor and fastening the inner keeper to the body part; and disposing the cover part over each of the at least one conductor and respective inner keeper and fastening the cover part to the body part.

According to a further development, the step of placing includes disposing two conductors on respective channels provided on the body part, and the step of disposing an inner keeper includes disposing one inner keeper on each conductor and fastening each inner keeper to the body part using a U-bolt.

The accompanying drawings are incorporated into and form a part of the specification for the purpose of explaining the principles of the invention. The drawings are not to be construed as limiting the invention to only the illustrated and described examples of how the invention can be made and used.

BRIEF DESCRIPTION OF THE FIGURES

Further features and advantages will become apparent from the following and more particular description of the invention as illustrated in the accompanying drawings, in which.

DETAILED DESCRIPTION OF THE INVENTION

Advantageous embodiments of an electromagnetic actuator constituted according to the invention will now be described in further detail with reference to the accompanying drawings.

Figure 3A:
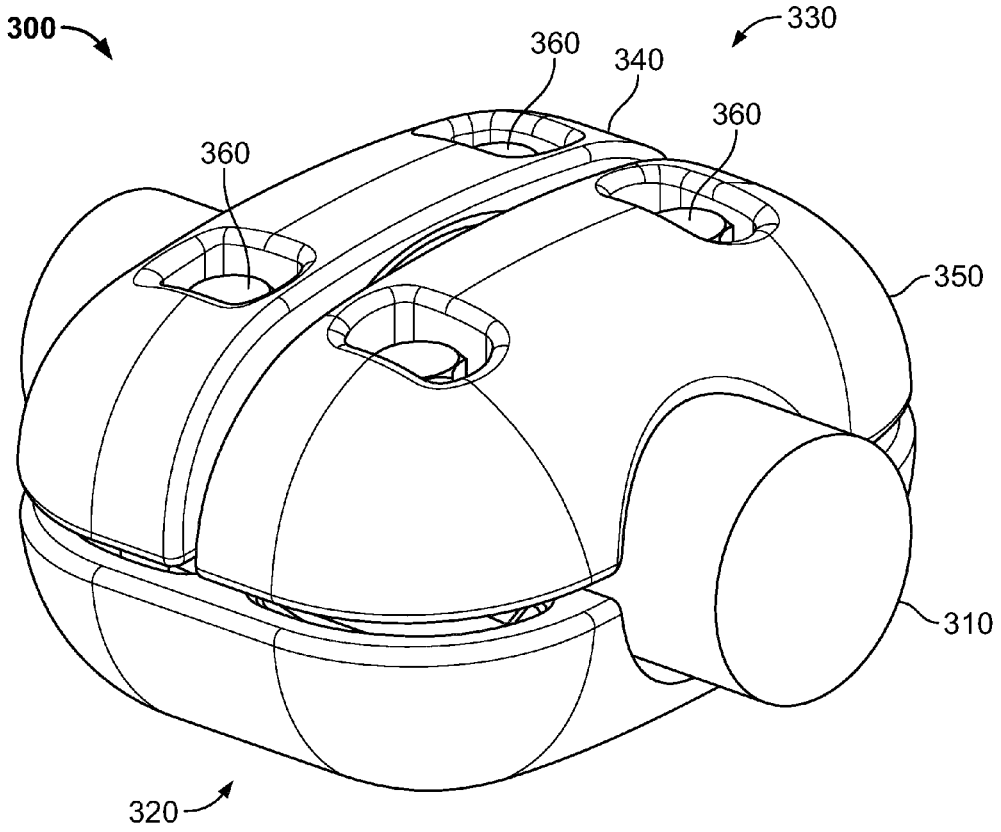
FIG. 3A shows a perspective view of the electrical connector according to the present invention in a fully assembled state.

FIG. 3A illustrates an embodiment of a fully assembled electrical connector 300 disposed along a conductor 310.

The connector 300 includes a body part 320 and a cover part 330 adapted to be assembled together for forming a connector body, accordingly, which serves the purpose of conducting the electrical current and protecting the conductor against external agents, such as environmental conditions and corona discharges, as well as of keeping the conductor 310 into place. In FIG. 3A the conductor 310 is illustrated as extending longitudinally between opposed sides of the connector 300. However, the connector 300 may be conveniently used for connecting to an end of a conductor, as will be described later.

In the illustrated embodiment, the cover part 330 is formed by two separate elements, which will be referred to as outer keepers, a first outer keeper 340 and a second outer keeper 350 which are coupled to the body part 320 by a set of fasteners 360. This configuration has the advantage of facilitating on-site installation of the connector 300, particular to connectors above ground level and/or of large dimensions.

The two outer keepers 340, 350 are preferably designed with a similar shape defining two symmetric halves that form a mirrored image from each other when symmetrically arranged, opposed to each other, on the body part 320.

However, other configurations of the outer keepers may be envisaged depending on the application. For instance, one of the outer keepers may be longer along the longitudinal direction of the conductor than the other. In an alternative configuration, the two outer keepers may be rigidly connected to form a single cover part.

As shown in FIG. 3A, the body part 320 and the outer keepers 340, 350 are preferably designed with curved external surfaces and smooth edges for avoiding corona discharges that tend to develop at high voltages around sharp edges.

Each outer keeper 340 and 350 is provided with a respective set of fastening means 360, preferably a pair of straight bolts and respective nuts (not shown) for fastening each keeper over the conductor 310 to the underlying body part 320, thereby providing two fixations, a first and a second fixation, of the conductor 310 to the connector 300.

An additional fixation of the conductor 310 to the body part 320 is provided by an inner keeper 370 that is positioned between the conductor 310 and the outer keepers 340 and 350 as will be explained below with reference to FIG. 3B.

Figure 3B:
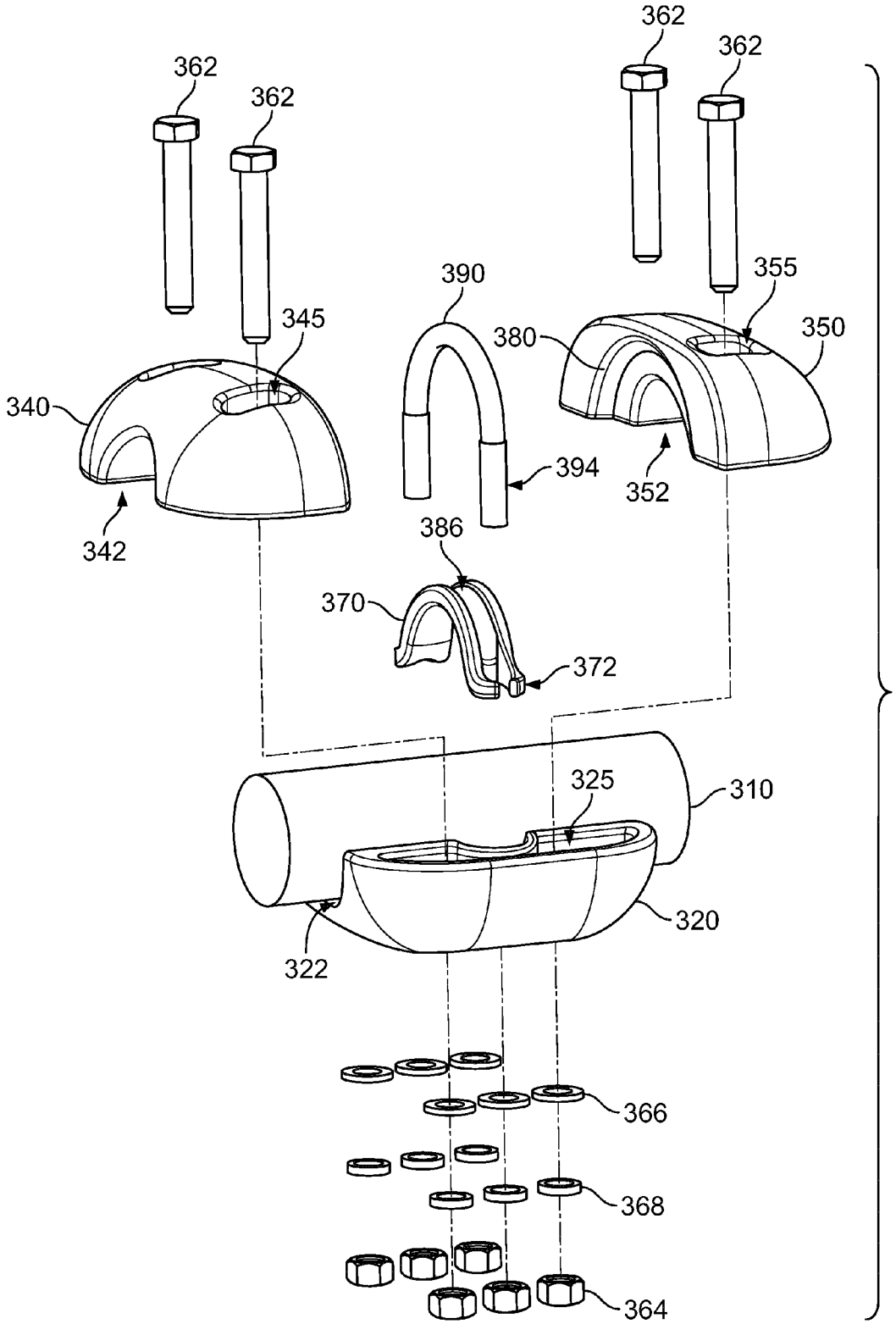
FIG. 3B shows an exploded view of the electrical connector shown in FIG. 3A.

As shown in FIG. 3B, the body part 320 has an inner profile defining a longitudinal cavity or groove 322 for receiving the conductor 310. This groove 322 may be complemented by opposed grooves 342 and 352 respectively defined on each of the inner sides of the outer keepers 340 and 350 facing the body part 320, thereby, forming a channel for axially accommodating the conductor 310 when the outer keepers 340 and 350 and the body part 320 are assembled together.

The shape of each of the grooves 322, 342 and 352 substantially follows the external surface of the conductor 310 so as to clamp the conductor 310 when the outer keepers 340 and 350 are brought into contact with the underlying conductor 310. A specific profile following the contour shape of the cover part 330 may be provided on the body part 320 for increasing the stability of the mated connector 300.

A pair of through-holes 345 and 355 is provided in the first and second outer keepers 340, 350, respectively, for passing a respective pair of straight bolts or screws 362 in a direction substantially transverse to the conductor 310. Each through-hole of the pair is disposed on each side of the channel, respectively, in such a manner that the through-holes on a same side are aligned in parallel respective to the channel. The body part 320 is provided with matching through-holes 325 for passing each bolt 362 and for receiving the corresponding nuts for tightening or releasing the bolts on the back side of the connector 300, that is, on the side opposed to the cover part 330. Each screw 362 is tightened or released from the back side of the connector 300 by means of a nut 364, which is interposed by a flat washer 366 and a spring washer 368.

A third fixation of the conductor 310 is provided by an inner keeper 370, which is partially hidden below the outer keepers 340 and 350 when the connector 300 is fully assembled.

As shown in FIG. 3B, the inner keeper 370 comprises a contact element, such as a strap, that is disposed transversally over the conductor 310 and extends along at least a part of the conductor external surface that is not covered by the channel 322. In the illustrated embodiment, the strap 370 has a profile with a C-shape that substantially follows the curvature of the conductor 310. The strap 370 is terminated by two extended portions 372 that extend outwards, each end portion 372 being provided with an opening for mechanically connecting the strap 370 to the body part 320 and passing a fastener.

In FIG. 3B, the fastening means of the inner keeper 370 comprises a curved bolt 390 with a curved part that substantially follows the curved profile of the strap 370 for fitting along its outer surface. In the present case, where the strap 370 has a C-shaped profile, the curved bolt is a U-bolt 390. However, a configuration may be envisaged in which the outer surface of the inner keeper and the respective curved bolt have another shape, such as a looped shape not necessarily circular or even a rectangular profile.

Preferably, the outer surface of the contact element 370 has a flange 386 for better fitting the U-bolt 390 around the strap 370 and increasing the mechanical stability of the assembly.

The U-bolt 390 is terminated by two straight, threaded ends 394 adapted to pass through the openings provided on the extended contact portions 372 of the strap 370 and matching through-holes (not shown) provided on the body part 320. Each threaded end 394 is tightened by a nut 364 on the other side of the body part 320 and has a length suitable for fixing the inner keeper 370 to the body part 320 and allowing the contact pressure exerted by the U-bolt 390 on the strap 370 against the conductor 310 to be adjust by releasing or tightening the nut 364.

The straight bolts 362 and the U-bolt 390 are preferably made of an electrically conductive material, such as aluminum alloy, and have a similar cross-section. The connector design may be conveniently adapted for using M12 bolts instead of M16 bolts in order to facilitate logistic of the fasteners and reduce costs.

Alternatively to a U-bolt 390, a pair of straight screws might also be used for fastening the strap 370 to the body part 320. The use of the U-bolt 390 has the advantage of distributing the contact pressure exerted over the strap 370, and therefore, the contact pressure transmitted to the conductor 310, along the whole contact area of the strap 370, thus improving the electrical and mechanical contact between the strap 370 and the conductor 310. As a consequence, the lateral dimension of the strap 370 can be optimized so as to occupy a reduced space inside the connector body.

In order to allow the strap 370 and the U-bolt 390 to be substantially covered by the outer keepers 340 and 350, while maintaining a regular external shape of the connector body and its transversal dimensions, the grooves 352 and 342 defined by the inner profile of the first and the second outer keepers 340 and 350 may include a recess 380 for accommodating the assembled strap 370 and U-bolt 390 when the connector 300 is mated. This allows the distance between the outer keepers 340 and 350 when mated to be reduced to a minimum, thereby, avoiding undesirable corona effects. The depth of the recess 380 may be adjusted so as to avoid the inner keeper 370 and the outer keepers 340, 350 to make contact with each other when the connector 300 is mated.

In another configuration, the cover part may be designed so that the inner keeper is covered by only one of the outer keepers. In this case, the recess may be provided only in the covering outer keeper.

In an alternative configuration where the cover part is provided has a single keeper, the single keeper is shaped so as to cover and completely hide the inner keeper inside the connector body. Preferably, the single keeper is provided with two pairs of straight bolts and nuts and respective two pairs of through-holes for fastening the single keeper to the body part, and thereby, provide the first and second fixation to the connector. In this case, the first and second fixations are preferably provided at each side of the inner keeper, respectively.

The connector 300 preferably includes a terminal portion (not shown) adapted to establish an electrical connection of the conductor 310 to another conductor or a piece of equipment of, for e.g., a high voltage installation.

Thus, an advantage of the present invention lies in the size of one of the connector pieces and therefore, the overall size of the connector being significantly reduced. Namely, since the space occupied by the intermediate keeper in the conventional three-keeper design is practically eliminated by the present invention, a reduction in length corresponding to the longitudinal size of the intermediate keeper may be achieved. For instance, in the case of a conventional connector with three keepers having substantially the same length, the design of the present invention may allow a reduction of about ⅓ of the overall length of the connector.

Figure 1:
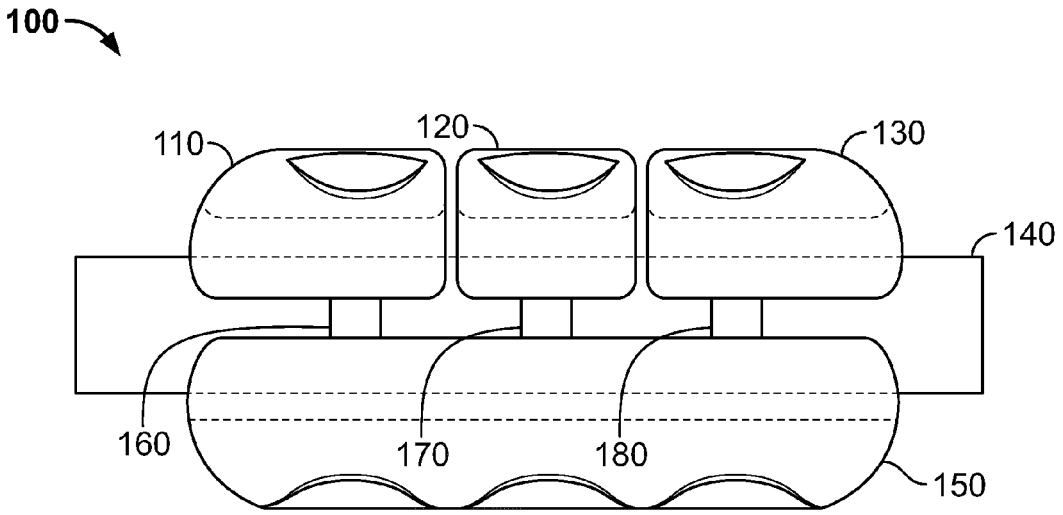
FIG. 1 schematically illustrates a side view of a conventional bolted-type connector having three keepers fastened by three pair of bolts and longitudinally disposed along a conductor.
Figure 2:
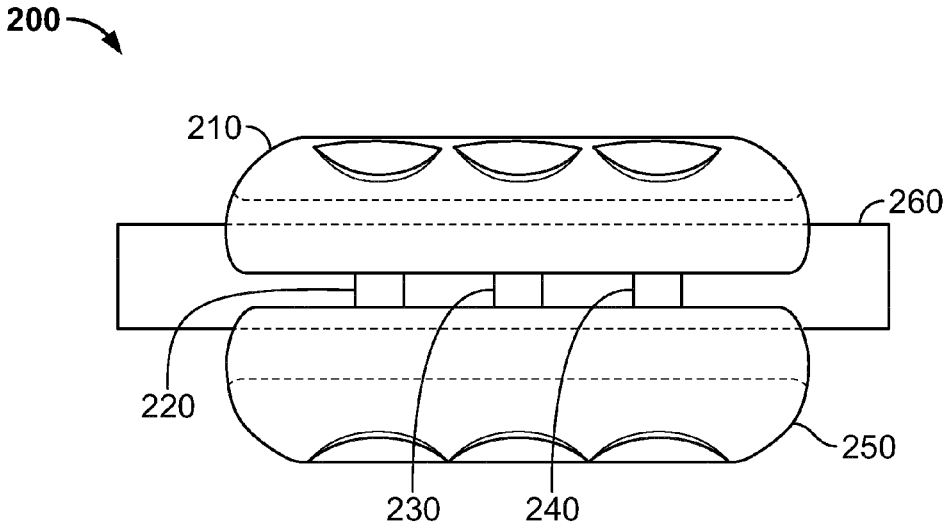
FIG. 2 schematically illustrates a side view of a conventional bolted-type connector having a single keeper fastened by six bolts and longitudinally disposed along a conductor.
Figure 4:
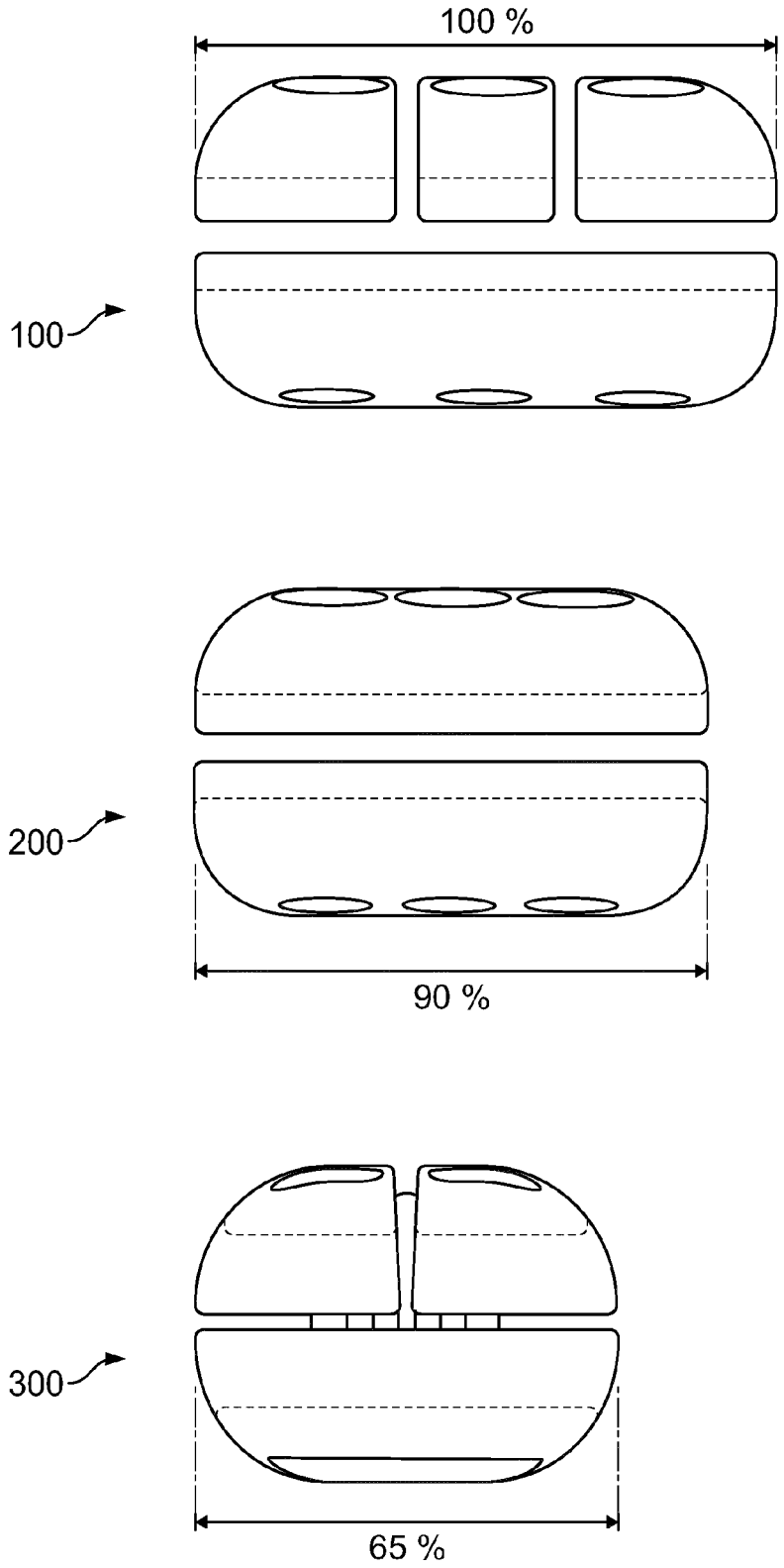
FIG. 4 illustrates a comparison (from top to bottom) of the longitudinal dimension of the bolted-type connectors shown in FIGS. 1 and 2 and of the electrical connector shown in FIGS. 3A-3B.

FIG. 4 shows a comparison of longitudinal length achieved with the electric connector design of the present invention in comparison with the specific examples of the three keeper design and the single keeper design described with reference to FIGS. 1 and 2, respectively.

As illustrated in FIG. 4, the connector design according to the present invention (lower figure) allows to reduce the connector longitudinal length. This reduction can achieve about 76 mm and 52 mm in comparison with the specific three keeper and the single keeper models discussed with reference to FIGS. 1 and 2, respectively. This corresponds to a longitudinal length of the electrical connector of about 65% and 90% in comparison with the longitudinal length of the conventional connectors shown in FIG. 1 and FIG. 2, respectively. This represents an economy of about 30% and 40% on the raw material used in the making of the connector in comparison with the prior art models, respectively, while keeping a 6-bolts connector design required by customers, which leads to a significant saving in material costs.

As will be immediately realized by those skilled in the art, the reduction of longitudinal length achieved by the present invention in comparison to a conventional connector with a three keeper or a single keeper design is not limited to the values discussed with reference to FIG. 4 and may be higher or lower than the indicated values depending on the specific design of the starting conventional connectors such as number and length of the individual keepers, spacing between keepers, etc.

In addition to the economy in raw material achieved with the design of the present invention, the application of the connector 300 to a conductor is greatly simplified through the use of the inner keeper 370 and the U-bolt 390, since these connector parts can be easily disposed over the conductor 310 and immediately fastened for providing an initial fixation point of the conductor 310 in comparison with the installation of a separate keeper with two screws.

Another advantage of the present connector design with a hidden inner keeper lies in obtaining a shorter contact length although using three keepers, which permits reducing the torque exerted on the connector during installation and increasing electrical contact pressure and tensile strengths.

The principles of the connector 300 described above may be conveniently applied to other configurations of electrical connectors, namely, for electrical connectors or interconnects suitable for electrically connecting more than one conductor.

Figure 5A:
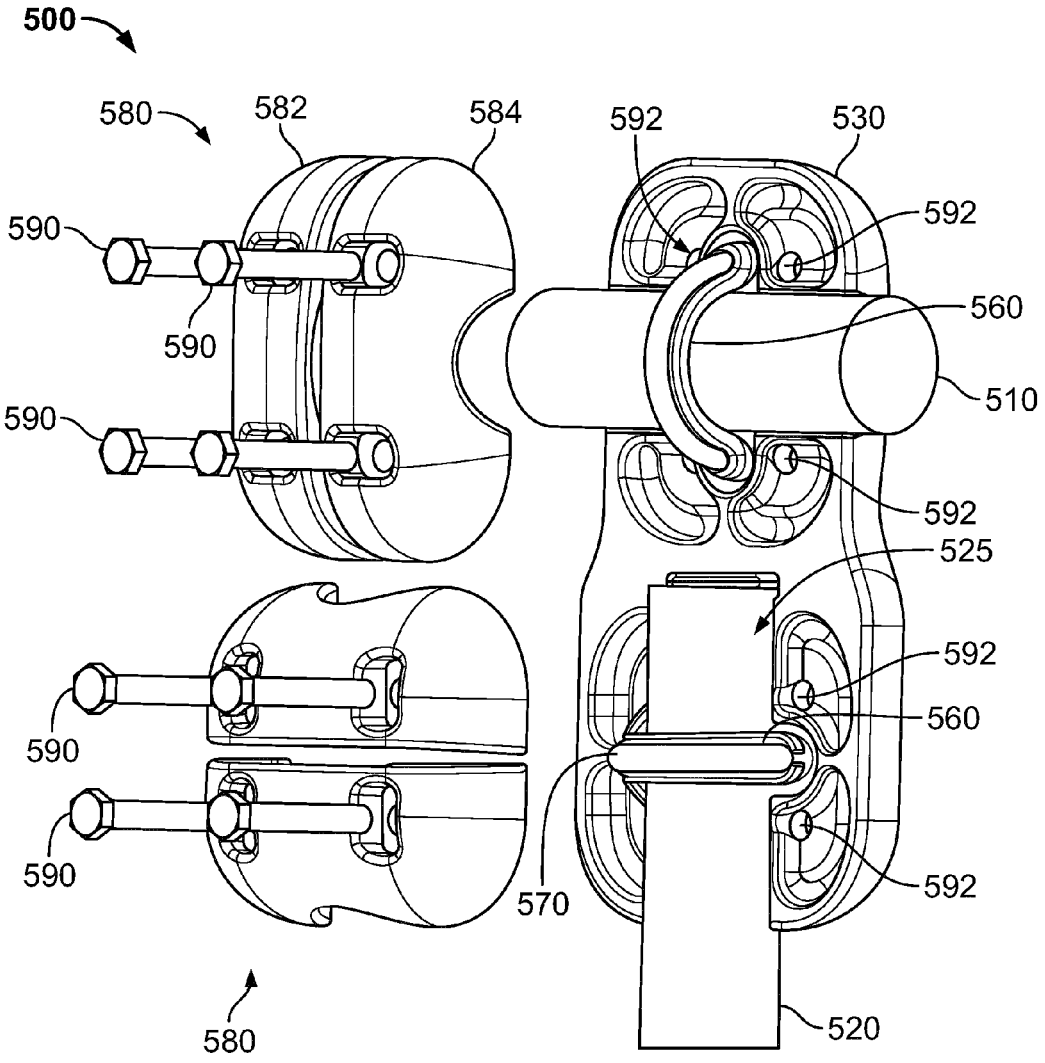
FIG. 5A shows an exploded view of a electrical connector with a T-shape configuration according to an embodiment of the present invention for interconnecting two transversal conductors to each other (view from a front side of the connector)
Figure 5B:
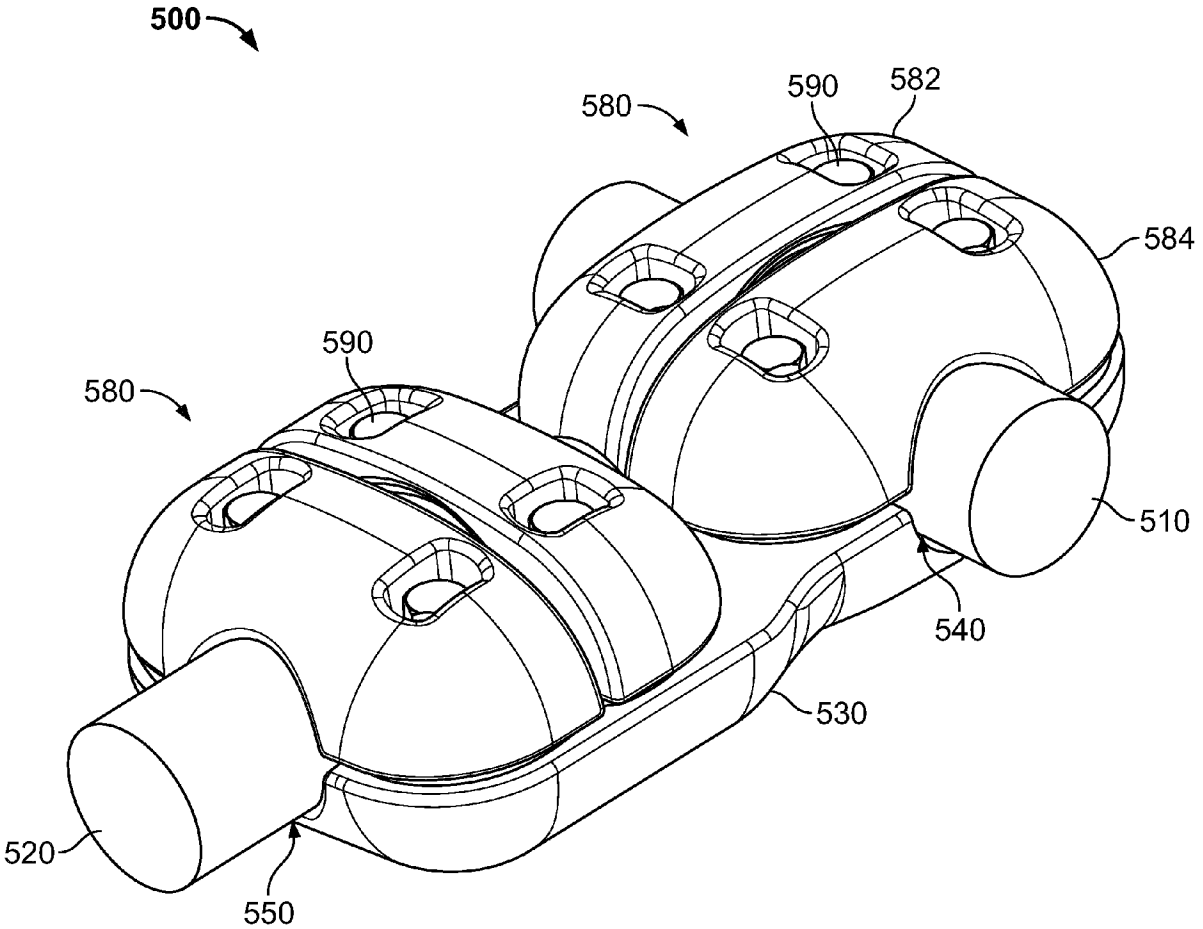
FIG. 5B shows a perspective view of the electrical connector of FIG. 5A in a fully assembled state when viewed from the front side of the connector.
Figure 5C:
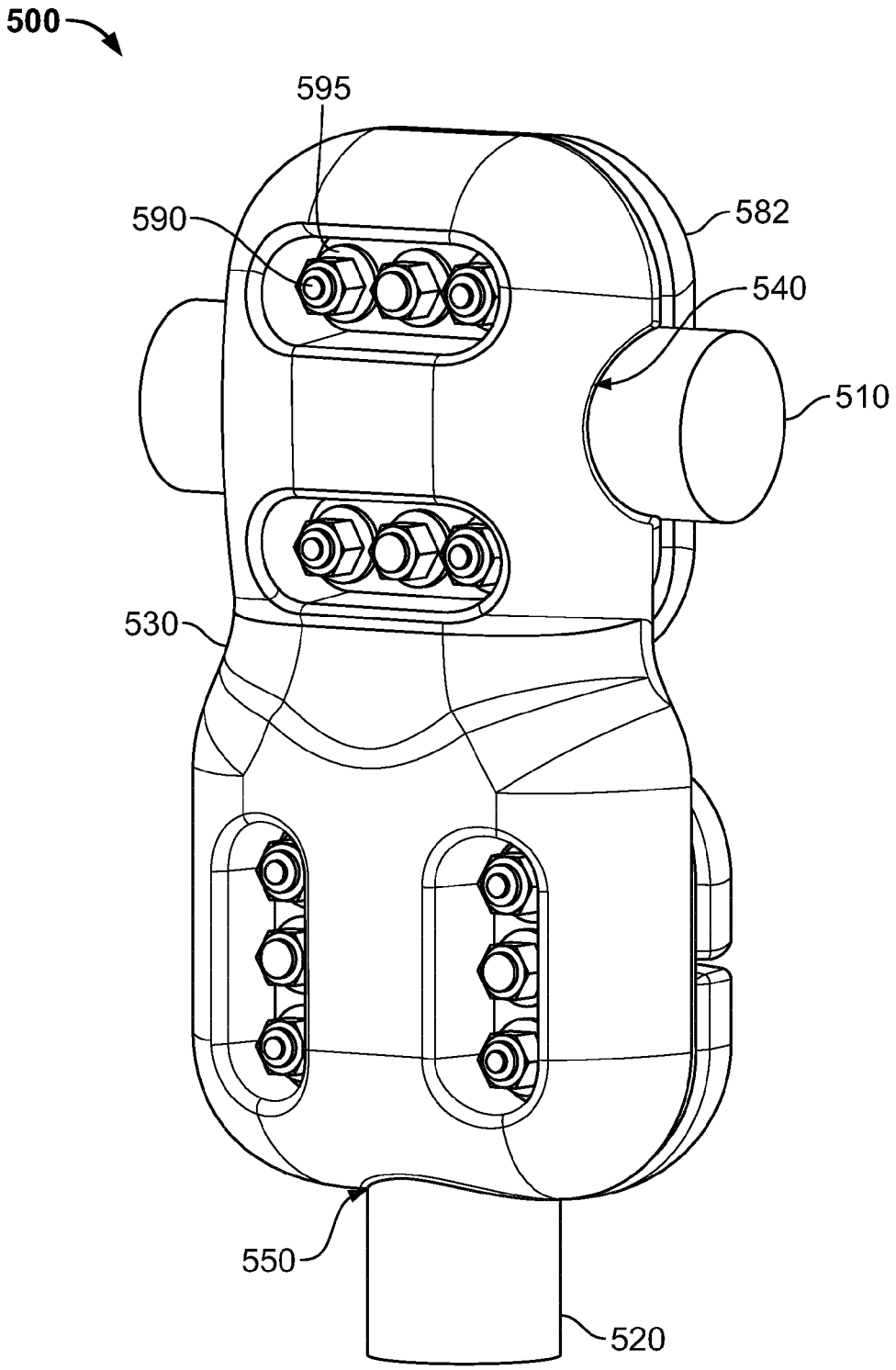
FIG. 5C shows a perspective view of the electrical connector of FIG. 5A in a fully assembled state when viewed from a back side of the connector.

FIGS. 5A to 5C show an embodiment of an electrical connector 500 for connecting two electrical conductors 510 and 520 in a T-shape configuration.

As shown in FIG. 5A, the connector 500 includes a body part 530 having an inner profile (not shown) that defines two channels 540 and 550 oriented perpendicularly with respect to each other for receiving two conductors 510 and 520, respectively. In the present configuration, one of the channels 540 is defined so as to cross the body part 530 along one direction for disposing the connector 500 along a longitudinally extending conductor 510, for instance, for making a tap connection. The second channel 550 is defined from the centre of the body part 530 outwards along a direction transverse to the first channel 540 and is designed for receiving an end part 525 of the second conductor 520.

In order to hold each conductor 510 and 520 on the respective channels 540 and 550 based on the three-fixation principle, an inner keeper 560 with a U-bolt 570 and a cover part 580 having two outer keepers 582 and 584 with corresponding fasteners 590 are provided for each conductor or channel disposed on the body part 530. With the exception of the body part 530, all connector parts and how they are mated are the same as described with reference to the connector shown in FIGS. 3A-3B.

The body part 530 has an extended form adapted to receive the two conductors 510 and 520 and for arranging the respective cover parts 580, accordingly. In the present case, the two covers 580 are arranged with an orientation of about 90 degrees with respect to each other due to the T-shape arrangement of the conductors 510 and 520. The body part 530 is provided with a set of 12 matching through-holes: 4 through-holes 592 for fastening each cover part 580 and 4 central through-holes (not shown) for fixing the inner keepers 560 with U-bolts 570.

As shown in FIG. 5C, the fasteners 590 and the U-bolts 570 are tightened by respective tightening nuts 595 provided on the back side of the connector 500, which is the side of the body part 530 opposed to the side facing the cover part 580. The through-holes of the body part 530 and cover part 580 are arranged transversally to each conductor channel 540 and 550, aligned in groups of three on each side of the respective channel and along a direction parallel to the channel.

In an alternative configuration, the inner profile of the body part 530 may be modified so as to be adapted to receive the end parts of two transversal conductors, namely, by changing the profile of the first channel 540.

Figure 6A:
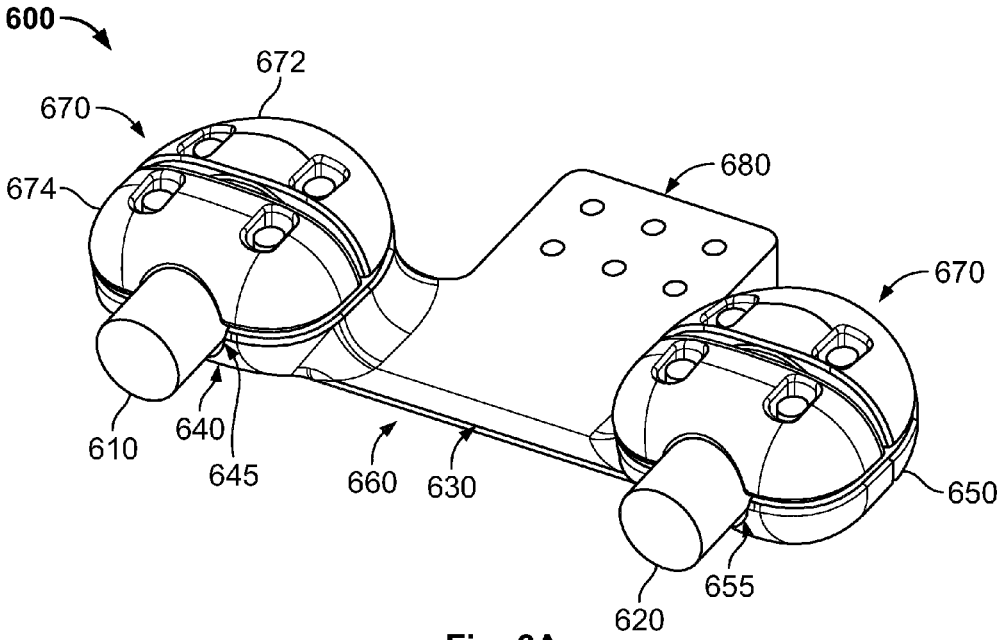
FIG. 6A shows a perspective view of an electrical connector for connecting two parallel conductors (view from a front side of the connector) according to an embodiment of the present invention.
Figure 6B:
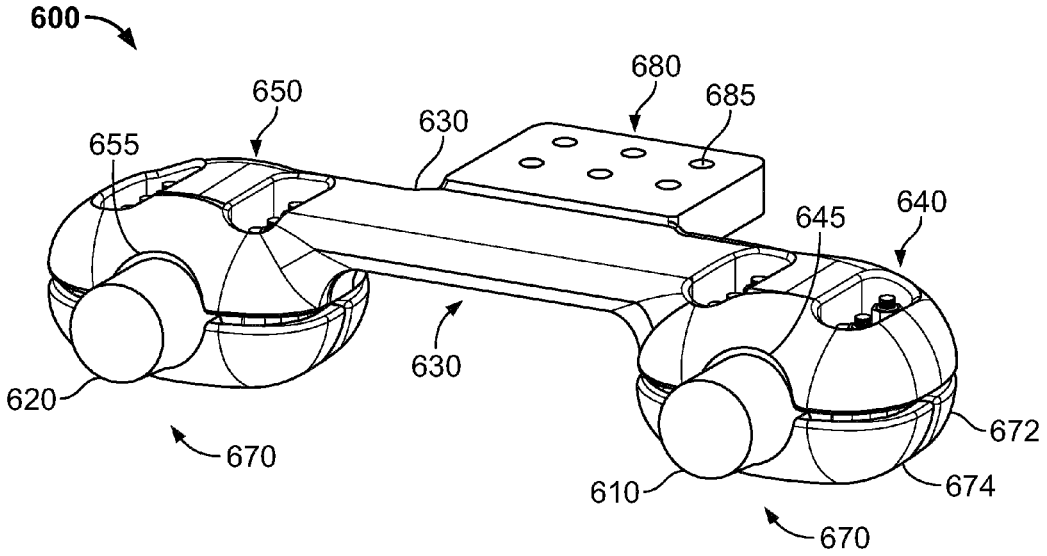
FIG. 6B shows a perspective view of the electrical connector of FIG. 6A when viewed from a back side of the connector.

FIGS. 6A and 6B illustrate an embodiment of an electrical connector 600 for electrically connecting two parallel conductors 610 and 620, when viewed from a front side and from a back side of the connector 600, respectively. In this configuration, the connector 600 has a body part 630 with two lobes 640 and 650, each lobe 640 and 650 having an inner profile defining respective grooves 645 and 655 for receiving a part of conductors 610 and 620, respectively. The lobes 640 and 650 are mechanically connected by a connector arm 660. The connector arm 630 may comprise a plate 680 provided with holes 685 for mounting the connector 600 to a frame or other equipment (not shown). Each lobe 640 and 650 is designed similarly to the body part 320 described with reference to FIGS. 3A-3B and is provided with a cover part 670, an inner keeper (not shown) and respective U-bolt (not shown) similar to the cover parts 330, the inner keeper 370 and U-bolt 390 described above. Namely, each cover part 670 includes two separate outer keepers 672 and 674 that provide two separate fixations of the respective conductor. These connector parts and their assembly on each lobe 640 and 650 are made in a similar manner as described above with reference to FIGS. 3A-3B.

Several modifications and combinations of the embodiments and alternative configurations described above may be envisaged without departing from the principles and advantages of the present invention.

For instance, although the description of the embodiments illustrated in FIGS. 5A-5C and FIGS. 6A-6B were made with reference to a cover part having two separate outer keepers, a modification of the illustrated connectors may be envisaged in which at least one of the cover parts is provided has a single outer keeper for covering and completely hiding the inner keeper inside the connector body. In this case, the single outer keeper is provided with two pairs of straight bolts and nuts and respective two pairs of through-holes for fastening the single outer keeper to the body part, and thereby, providing two fixations to the connector.

In another configuration, at least one of the cover parts may be designed with asymmetrical keepers, for e.g., having different longitudinal length and with different recesses such that the inner keeper is substantially or totally covered by one of the outer keepers. In this case, the recess may be provided only in the covering outer keeper.

In another configuration of the electronic connector having two channels for connecting two conductors, both cover parts may be provided as a single covering element with a shape that substantially follows the shape of the underlying body part.

As will also be realized by those skilled in the art, the principles of the invention as described with reference to FIGS. 3A-3B may be conveniently applied for electrical connectors adapted to connect a plurality of conductors, running in parallel to each other or with other orientations than parallel and T-shaped configuration.

In addition, although the above embodiments were described with reference to an electrical connector for ultra-high voltage applications (600 and above), the connector design of the present invention may be conveniently implemented for medium voltage applications.

In the embodiments described above, the conductors are a tubular rod made of an electrically conductive material such as aluminium or copper alloy and having a cross-section with the standard size of conductors used for connecting to high voltage power supplies. However, as will be immediately realized by those skilled in the art the connector of the present invention may be modified so as to be used for connecting other types of conductors and having cross-sections other than circular, for instance, electrical cables, and/or for interconnecting two conductors of different cross section.

Further, the inner keeper may take forms other than the one described above as long as it is provided with a shape suitable to be fitted between the conductor and the outer keepers and is provided with an inner contact surface adapted to be disposed transversally over the conductor and to exert contact pressure on the conductor when fastened to the body part.

Optionally, the connector of the present invention may be used only with the two outer keepers by removing the inner keeper, the U-bolt and the respective central trough-holes so as to comply with national specifications.

Finally, the terms first fixation, second fixation and third fixation used above are not to be construed as referring to an order to be followed for fixing the conductor to the connector but as simply referring to the number of fixations provided by the electrical connector. Further, the terms front side and back side are used herein to refer to the side of the electrical connector when viewed, in a fully assembled state, from the side of the cover part and the body part, respectively.

REFERENCE NUMERAL LIST

| Reference Numeral | Description |
|---|---|
| 100 | Conventional three-keeper connector |
| 110, 120, 130 | Keepers |
| 140 | Conductor |
| 150 | Body member |
| 160, 170, 180 | Pairs of fasteners |
| 200 | Conventional single keeper connector |
| 210 | Single keeper |
| 220, 230, 240 | Pairs of bolts |
| 250 | Body part |
| 260 | Conductor |
| 300 | Electrical connector |
| 310 | Conductor |
| 320 | Body part |
| 322 | Groove of body part |
| 325 | Through-hole in body part |
| 330 | Cover part |
| 340, 350 | Outer keepers |
| 342, 352 | Groove of keepers |
| 345, 355 | Through-hole in outer keeper |
| 360 | Fastening means |
| 362 | Screws |
| 364 | Nut |
| 366 | Flat washer |
| 368 | Spring washer |
| 370 | Inner keeper, strap |
| 372 | Extended contact portions of strap |
| 380 | recess |
| 386 | Flange |
| 390 | U-bolt |
| 394 | Threaded ends of U-bolt |
| 500 | Electrical connector |
| 510, 520 | Perpendicular conductors |
| 525 | End part of conductor |
| 530 | Body part |
| 540, 550 | 1st and $2^{nd}$ channels |
| 560 | Inner keeper |
| 570 | U-bolt |
| 580 | Cover part |
| 582, 584 | Outer keepers |
| 590 | Fasteners |
| 592 | Through-holes in body part |
| 595 | Nuts |
| 600 | Electrical connector |
| 610, 620 | Conductors |
| 630 | Body part |
| 640, 650 | Lobes |
| 645, 655 | Grooves on lobes |
| 660 | Connector arm |
| 670 | Cover part |
| 672, 674 | Outer keepers |
| 680 | Connector plate |
| 685 | Holes |

The invention claimed is:

1. An electrical connector for medium and high voltage applications, comprising:

a connector body comprising:

a body part having an inner profile adapted to receive a conductor therein, a cover part having at least one outer keeper adapted to be fastened to the body part and being profiled to contact the conductor to provide a fixation of the conductor;

at least one outer keeper fastening member to couple the outer keeper to the conductor;

an inner keeper adapted to be fastened to the body part and being profiled to contact the conductor to provide another fixation of the conductor;

at least one inner keeper fastening member to couple the inner keeper to the conductor;

wherein the inner keeper and the cover part are shaped so that the at least one outer keeper covers, at least partially, the inner keeper, and wherein the inner keeper fastening member and the outer keeper fastening member independently couple the inner keeper and the outer keeper to the conductor.

2. An electrical connector according to claim 1, wherein the cover part has a first outer keeper and a second outer keeper, each outer keeper being adapted to provide a fixation of the conductor.

3. An electrical connector according to claim 2, wherein the first and second outer keepers are separate elements adapted to be symmetrically disposed on the body part with respect to the inner keeper and to substantially cover the inner keeper.

4. An electrical connector according to claim 2, wherein the first and second outer keepers form a single covering element adapted to completely cover the inner keeper.

5. An electrical connector according to claim 2, wherein the first outer keeper and the second outer keeper are each provided with a pair of through-holes and a pair of straight bolts for fastening to the body part, each through-hole of the pair being disposed transversally to the conductor and on each side of the conductor in such a manner that the through-holes on a same side are aligned in parallel to the conductor.

6. An electrical connector according to claim 2, wherein the first and the second outer keepers have a profile on a side facing the body part that is adapted to exert contact pressure on the conductor when the first and the second outer keepers are fastened to the body part for providing the respective fixations, at least one of the first and second outer keepers has a recess adapted to fit the inner keeper, and the body part and the cover part are shaped so as to provide a smooth external shape of the connector body when assembled together.

7. An electrical connector according to claim 1, wherein the inner keeper has an inner curved surface adapted to be disposed transversally over the conductor and to exert contact pressure on the conductor when fastened to the body part.

8. An electrical connector according to claim 1, wherein the inner keeper comprises a strap adapted be disposed transversally over the conductor and to extend along a part of the conductor surface, and the inner keeper fastening member is adapted to fasten the strap to the body part.

9. An electrical connector according to claim 8, wherein the inner keeper fastening member comprises a curved bolt having a curved profile adapted to be arranged along an outer surface of the strap and terminated by straight ends adapted pass through respective openings provided on the body part.

10. An electrical connector according to claim 9, wherein the strap has a substantially C-shaped profile and the curved bolt is a U-bolt.

11. An electrical connector according to claim 9, wherein the outer surface of the strap has a flange adapted to accommodate the curved bolt.

12. An electrical connector according to claim 1, wherein the inner profile of the body part defines a plurality of channels, each channel being adapted to accommodate a conductor therein; the connector comprising a cover part for each channel and an inner keeper for each channel provided with an inner keeper fastening member for fixing each conductor on the respective channel.

13. An electrical connector according to claim 12, wherein the body part has an extended form adapted to receive at least two conductors that are substantially perpendicular or parallel to each other therein, and to arrange the cover part and the inner keeper for fixing each conductor.

14. An electrical connector according to claim 1, further comprising a plurality of inner and outer fastening members.

15. A method of connecting at least one conductor to an electrical connector according to claim 1, the method comprising steps of:

placing at least one conductor on the body part;

disposing an inner keeper on the at least one conductor and fastening the inner keeper to the body part; and disposing the cover part over the at least one conductor and respective inner keeper and fastening the cover part to the body part.

16. A method according to claim 15, wherein:

the step of placing includes disposing two conductors on respective channels provided on the body part, and the step of disposing an inner keeper includes disposing one inner keeper on each conductor and fastening each inner keeper to the body part using a U-bolt.

17. An electrical connector for medium and high voltage applications, comprising:

a connector body comprising:

a body part having an inner profile adapted to receive a conductor therein, and a cover part having at least one outer keeper adapted to be fastened to the body part and to provide a fixation of the conductor;

an inner keeper adapted to be fastened to the body part and to provide another fixation of the conductor;

wherein the inner keeper and the cover part are shaped so that the at least one outer keeper covers, at least partially, the inner keeper;

wherein the cover part has a first outer keeper and a second outer keeper, each outer keeper being adapted to provide a fixation of the conductor; and wherein the first and second outer keepers are separate elements adapted to be symmetrically disposed on the body part with respect to the inner keeper and to substantially cover the inner keeper.

18. An electrical connector according to claim 17, wherein the first and second outer keepers form a single covering element adapted to completely cover the inner keeper.

19. An electrical connector according to claim 17, wherein the inner keeper has an inner curved surface adapted to be disposed transversally over the conductor and to exert contact pressure on the conductor when fastened to the body part.

20. An electrical connector according to claim 17, wherein the inner keeper comprises a strap adapted be disposed transversally over the conductor and to extend along a part of the conductor surface, and is provided with an inner keeper fastening member adapted to fasten the strap to the body part.

21. An electrical connector according to claim 20, wherein the inner keeper fastening member comprises a curved bolt having a curved profile adapted to be arranged along an outer surface of the strap and terminated by straight ends adapted pass through respective openings provided on the body part.

22. An electrical connector according to claim 21, wherein the strap has a substantially C-shaped profile and the curved bolt is a U-bolt.

23. An electrical connector according to claim 21, wherein the outer surface of the strap has a flange adapted to accommodate the curved bolt.

24. An electrical connector according to claim 17, wherein the first outer keeper and the second outer keeper are each provided with a pair of through-holes and a pair of straight bolts for fastening to the body part, each through-hole of the pair being disposed transversally to the conductor and on each side of the conductor in such a manner that the through-holes on a same side are aligned in parallel to the conductor.

25. An electrical connector according to claim 17, wherein the first and the second outer keepers have a profile on a side facing the body part that is adapted to exert contact pressure on the conductor when the first and the second outer keepers are fastened to the body part for providing the respective fixations, at least one of the first and second outer keepers has a recess adapted to fit the inner keeper, and the body part and the cover part are shaped so as to provide a smooth external shape of the connector body when assembled together.

26. An electrical connector according to claim 17, wherein the inner profile of the body part defines a plurality of channels, each channel being adapted to accommodate a conductor therein; the connector comprising a cover part and an inner keeper provided with an inner keeper fastening means as defined in any one of the preceding claims for fixing each conductor on the respective channel.

27. An electrical connector according to claim 26, wherein the body part has an extended form adapted to receive at least two conductors that are substantially perpendicular or parallel to each other therein, and to arrange the cover part and the inner keeper for fixing each conductor.

* * * * *